US007275402B2

(12) United States Patent
Lüling et al.

(10) Patent No.: US 7,275,402 B2
(45) Date of Patent: Oct. 2, 2007

(54) LOCK

(75) Inventors: Harald Lüling, Meinerzhagen (DE); Hermann-Josef Wüllner, Attendorn (DE)

(73) Assignee: Burg-Waechter KG (DE)

( * ) Notice: Subject to any disclaimer, the term of this patent is extended or adjusted under 35 U.S.C. 154(b) by 3 days.

(21) Appl. No.: 10/507,978

(22) PCT Filed: Mar. 14, 2003

(86) PCT No.: PCT/EP03/02670

§ 371 (c)(1),
(2), (4) Date: Mar. 25, 2005

(87) PCT Pub. No.: WO03/078766

PCT Pub. Date: Sep. 25, 2003

(65) Prior Publication Data

US 2006/0138789 A1 Jun. 29, 2006

(30) Foreign Application Priority Data

Mar. 16, 2002 (DE) ..... 102 11 713
Jun. 10, 2002 (DE) ..... 102 25 490

(51) Int. Cl.
*E05B 13/00* (2006.01)

(52) U.S. Cl. ..... 70/472; 70/222; 70/278.7; 70/279.1; 70/386; 70/422

(58) Field of Classification Search ..... 70/283, 70/277, 279.1, 278.7, 188, 189, 386, 422, 70/222, 223, 218, 472, 149, 358; 292/358, 292/DIG. 27

See application file for complete search history.

(56) References Cited

U.S. PATENT DOCUMENTS 467,039 A * 1/1892 Mathesen ..... 292/358
671,018 A * 4/1901 Gonne ..... 292/358
671,943 A * 4/1901 Smith ..... 292/353

(Continued)

FOREIGN PATENT DOCUMENTS

DE 199 60 791 C1 4/2001
DE 199 16 791 C2 10/2001
EP 1079050 A1 * 2/2001

*Primary Examiner*—Lloyd A. Gall
(74) *Attorney, Agent, or Firm*—Ryan A. Schneider, Esq; Troutman Sanders, LLP

(57) ABSTRACT

A lock, such as a mortise lock, for a door. The lock comprises a locking cylinder that can be inserted into a door leaf and a shaft having two sections, each section of the shaft having a handle at the end, preferably a rotary knob or a standard door handle and being actively interconnected by a coupling after recognition of an authorisation code. The lock can be used for various applications as a result of its construction design, with a standard locking cylinder in various doors and that it allows, a simple, reliable, low-energy actuation of the locking mechanism. To achieve this, the coupling (11) comprises at least two, preferably four or more rolling members (17) that are guided in recesses (18) of a second part (10) of a first section (5) of the shaft (3). The rolling members can be pushed into cavities (20) that run around the periphery of the first part (9) of the first section (5) of the shaft (3), in order to actively connect a first part (9) and the second part (10) of the first section (5) of the shaft (3), using a radially or axially displaceable sliding element (22).

27 Claims, 13 Drawing Sheets

U.S. PATENT DOCUMENTS

| | | | | |
|---|---|---|---|---|
| 797,137 | A * | 8/1905 | Marion | 700/149 |
| 1,731,935 | A * | 10/1929 | Petermann | 292/358 |
| 5,475,996 | A * | 12/1995 | Chen | 70/279.1 |
| 6,286,347 | B1 * | 9/2001 | Frolov | 70/472 |
| 6,427,505 | B2 * | 8/2002 | Imedio Ocana | 70/422 |
| 6,581,423 | B2 * | 6/2003 | Lin | 70/107 |
| 6,647,753 | B2 * | 11/2003 | Engler | 70/472 |
| 6,651,468 | B2 * | 11/2003 | Aramburu et al. | 70/222 |
| 6,837,081 | B2 * | 1/2005 | Ruano Aramburu et al. | 70/218 |
| 7,096,698 | B2 * | 8/2006 | Walsh et al. | 70/472 |
| 2003/0019256 | A1 * | 1/2003 | Frolov | 70/222 |
| 2004/0144143 | A1 * | 7/2004 | Don | 70/472 |
| 2005/0092046 | A1 * | 5/2005 | Errani et al. | 70/283 |
| 2006/0021404 | A1 * | 2/2006 | Menta San Miguel | 70/472 |
| 2006/0196238 | A1 * | 9/2006 | Avni | 70/218 |

* cited by examiner 4
35
2
3
41
39
40
37
9
17
36
20
11
18
10
20
37
36
5
38
54
54
22
43
25
56
34
24
38
6
59

LOCK

BACKGROUND

1. Field of the Invention

This invention relates to a lock, in particular a mortise lock for a door. Said lock comprises a locking cylinder that can in particular be inserted into a door leaf and a shaft consisting of two sections, each section of said shaft having a handle at the end, preferably a rotary knob or a standard door handle, and being actively interconnected by means of a coupling after recognition of an authorisation code.

2. Description of Related Art

Locks of this kind are known from prior art. They are built into door leafs particularly in the entrance door area, the opening and closing of the door, i.e. the movement of a catch bolt being accomplished via the shaft. To this end, said shaft includes an outside door handle, in particular a freely rotatable rotary knob that allows the catch bolt to be actuated only upon prior verification of an authorisation code through the locking cylinder. On the inside of the door there is also provided a handle, in particular a rotary knob. But this handle always serves for opening the door, even without verification of the authorisation code for actuation of the catch bolt. This makes sure that a door which is constructed in this way can always be opened from inside a building, whereas access to the building is possible only if an appropriate authorisation code has been entered before, which authorisation code produces the active interconnection between said outside door handle and said catch bolt. Said authorisation code may be entered mechanically or electronically. For example, the authorisation code can be the locking secret of a conventional key. On the other hand, it is possible to communicate the authorisation code via a keyboard or in a wireless fashion, for example through radio communication.

From DE 199 16 791 C1 a lock is known which can be designed as a mortise lock for a door. This lock includes a shaft which is subdivided in two sections, each of which having a handle, and the catch bolt of the lock being operable through a section of said shaft. To this end, a coupling is provided in the door outside area, which coupling actively interconnects the outside section of the shaft in said door with the inside section of the shaft in said door after recognition of an authorisation code. However, a considerable drawback can already be recognized here in as much as said coupling is arranged in the region of the outside section of the shaft, so that it may possibly be easily accessed and manipulated. Another drawback of this known lock is that doors of different thickness require the use of locking cylinders of a different length, which locking cylinders are normally penetrated by said shaft.

Further known from DE 198 24 713 A1 is a locking cylinder having a housing and a locking member supported for rotation within said housing. Said locking member is connected to a driving shaft that is divided in two sections that can be actively interconnected by means of a coupling. Said coupling is formed as a solenoid and is activated by a control electronic in dependence of an access authorisation.

BRIEF SUMMARY OF THE INVENTION

Starting from this prior art the invention is based on the problem of developing a lock of this type in such a way that it can be used for various applications as a result of its construction design, in particular with a standard locking cylinder in various doors and that it allows, in particular, a simple, reliable, low-energy actuation of the locking mechanism.

The solution of this problem provides that the coupling comprises at least two, preferably four or more rolling members that are guided in recesses of a second part of a first section of the shaft. Said members can be pushed into cavities that run around the periphery of the first part of the first section of the shaft, in order to actively connect a first part and the second part of the first section of the shaft, using a radially or axially movable sliding element.

The lock according to the invention stands out due to the coupling including at least two, preferably four or more rolling members that are guided in recesses of the second part of the first section of the shaft, which rolling members are pushed into cavities that run around the periphery of the first part of the first section of the shaft, in order to actively connect the first part and the second part of the first section of the shaft, using a radially or axially movable sliding element.

When the sliding element is in its initial position, the rolling members will substantially be in their recesses of the second part of the first section of the shaft. Any active connection between the first part and the second part of the first section of the shaft will not be possible then. When the sliding element is displaced towards the shaft it will push the rolling members into the recesses that run around the periphery of the first part, thereby producing a positive and/or frictional locking between said two parts of the first section of the shaft. This positive and/or frictional locking of the two parts of the first section of the shaft leads to an active interconnection of these two parts of the first section of the shaft, as a result of which the locking pin of the lock can be operated through the outside door handle.

Said rolling members are, in particular, formed as balls or rolls.

According to a further feature of the invention it is provided that the sliding element is displaceable in the radial direction of the shaft through a knee lever. Such a knee lever offers the advantage that it can be operated with relatively low forces, while producing high forces on the output side.

According to a further feature of the invention it is provided that the sliding element is driven by an electric motor including on the output side thereof a worm with a spring guided therein which has two arms and is articulated in said worm by its one arm and to the sliding element by its second arm. This construction offers the advantage that only little energy is required for moving the arm of the spring that is guided in the worm from one end of the worm to the second end of the worm. In addition, the spring compensates tolerances between the movement of the motor and the movement of the sliding element and represents an economical construction.

According to a further feature of the invention it is provided that the rolling members are juxtaposed in plural and at least in two rows side by side. With at least two parallel rows of rolling members the advantage is that smooth operation of the two coaxially arranged parts of the first section of the shaft is attained, which also has an effect on the actuation of the coupling. While a number of two rolling members may be always provided in the lock, it would be advantageous to have a number of at least four or for example also six or eight rolling members per row.

As an alternative of an electric motor with spring the driving unit of the sliding element can also be designed as a lifting magnet. Such a construction can result in a smaller construction size, and it has shown to be advantageous to arrange a spring between the sliding element and the lifting magnet.

To make safe running of the rolling members and the sliding element possible it has proven to be advantageous to arrange the sliding element in a housing that covers the bores and the rolling members. The construction size of a lock of this type can be advantageously reduced by that the second part of the first section of the shaft has a diameter reduction in the region of the bores with the rolling members which substantially corresponds to the width of the sliding element. This diameter reduction also serves for radially guiding the sliding element.

As an alternative of a radial movement of the sliding element also an axial movement of the sliding element can be provided. In such a case the sliding element includes an inclined surface extending in an axial direction by means of which a rolling member is displaced in such a way that an active connection between the coaxially aligned two parts of the first section of the shaft is produced.

An alternative design of the lock provides that the sliding element is displaceable in the axial direction of a shaft through a lever. This design offers, in particular, the advantage that the lock can have a compact construction because of the lever being axially movable, and all the components can be integrated in a locking cylinder of a usual size.

A further development of this embodiment provides that the lever is supported for rotation in the locking cylinder by one end thereof. The second end of the lever preferably engages an opening of the sliding element. It is further provided that the lever is guided with its central part in a worm wheel that is arranged on the driving shaft of the driving motor. Only a few rotations of the driving shaft of the driving motor are sufficient for reciprocating the sliding element by means of the lever between the two positions, in order to obtain the engaged or disengaged positions. The low number of required rotations of the driving shaft of the driving motor results in a very good energy balance and helps to a low energy requirement, so that corresponding energy storage means such as batteries or accumulators can have a very small size.

In an alternative embodiment the lever can be formed as a frame and include two projections which serve for connecting the lever to the sliding element on one side and to the locking cylinder on the other side. The lever is formed as a frame particularly for reasons of stability, which stability is important for the filigree components discussed herein. In addition, the frame construction offers advantages in guiding the lever on the worm wheel. Owing to its construction as a frame the lever can embrace the worm wheel.

Constructed in this way, the lever is fixed by its first projection to a gudgeon that is arranged so as to extend in the longitudinal direction of the sliding element and is fixed to the latter for pivoting. Preferably, said lever takes support on a tension and/or compression spring that is arranged on the gudgeon.

The connection of the lever to the worm wheel is preferably effected through two pins that a directed toward each other and engage with the thread of the worm wheel, thereby producing a form-fit connection between the worm wheel and the lever.

According to a further feature of the invention it is provided that in the sliding element on both sides of the second end of the lever there is respectively arranged at least one spring which is bent or released when the lever is moved. In their quality as energy storage means these springs support the movement of the lever and therefore are advantageous with respect to the required energy of the driving motor.

Preferably, the driving motor is arranged in the locking cylinder, in order to make a construction unit which is easy to mount. This further development also offers the advantage that already existing cavities and bores in the door leaf can be used when doors are retro-fitted. Accordingly, retro-fitting of existing doors with the lock according to the invention is easily possible.

As it is usual, the lock includes a locking nose which, according to the invention, is fixed for rotation with the shaft, particularly with the first section of the second part of the shaft. Preferably the locking nose is arranged on an annular body surrounding the shaft, in particular the first section of the second part of the shaft, which annular body has a bore receiving a pin, which bore is coaxially aligned with a bore in the shaft. This pin allows the locking nose to be securely mounted against rotation on the shaft.

According to a further feature of the invention it is provided that the bore extends up and into the locking nose, so that a pin of a relatively long length can be used to make the connection more stable.

It is further provided that the pin extends through a tangentially aligned groove in the first part of the shaft, so that the pin secures the shaft against its forcible removal also in the axial direction.

A further development of the lock provides that a first section of the shaft is formed in two parts, the coupling for producing the active connection after recognition of an authorisation code not being arranged between the two sections of the shaft but between the two parts of the first section of the shaft. This allows the shaft to be simply arranged in such a way that the coupling is provided on the inner side of the door, so that it is not or only hardly accessible from outside and hence burglarproof because it cannot be manipulated. In the lock according to the invention it is further provided that the two sections of the shaft are connected in a length-variable fashion, so that the shaft can be simply adjusted for door leafs of a different thickness, whereby the advantage is obtained that the lock according to the invention always allows the use of locking cylinders of a particular size. Accordingly, it is not necessary that locking cylinders of different lengths are used depending of the respective thickness of the door leaf.

According to a further feature of the invention it is provided that the two parts of the first section of the shaft are arranged coaxially to one another, thereby obtaining the advantage, in particular, that the lock according to the invention has a very compact construction.

It is further provided that the second section of the shaft has at least two diametrically opposite, axially aligned cavities that are engaged in a form-fit fashion by corresponding projections of the first part of the first section of the shaft. The form-fit connection of the two sections of the shaft results in a safe operation, with sufficient stability of the construction being given, which stability allows a reliable connection of the two sections of the shaft also in the case where high rotational forces for opening the catch bolt are required.

Preferably, the second part of the first section of the shaft is connected to a locking nose of the cylinder. The locking nose is, in particular, arranged in a manner fixed against rotation on a shaft section that extends coaxially with the first part of the section of the shaft and is connected in a form-fit fashion to the second part of the first section of the shaft. Preferably, the section of the shaft can be adjusted in a length-variable fashion with respect to the second part of the first section of the shaft, so that in this case, too the interconnected and interacting components can be precisely adjusted in order to keep the forces of movement within the lock small.

According to a further feature of the embodiment it is provided that the section of the shaft includes at least two diametrically opposite, axially aligned cavities which are engaged by corresponding projections of the second part of the first section of the shaft in a form-fit fashion.

BRIEF DESCRIPTION OF THE DRAWINGS

Further features and advantages of the invention will become apparent from the following description of the accompanying drawing showing a preferred embodiment of the lock according to the invention. In the drawing it is shown by FIG. 1 a part of a lock in a shaft and a locking cylinder in a perspective side view.

DETAILED DESCRIPTION

Figure 1:
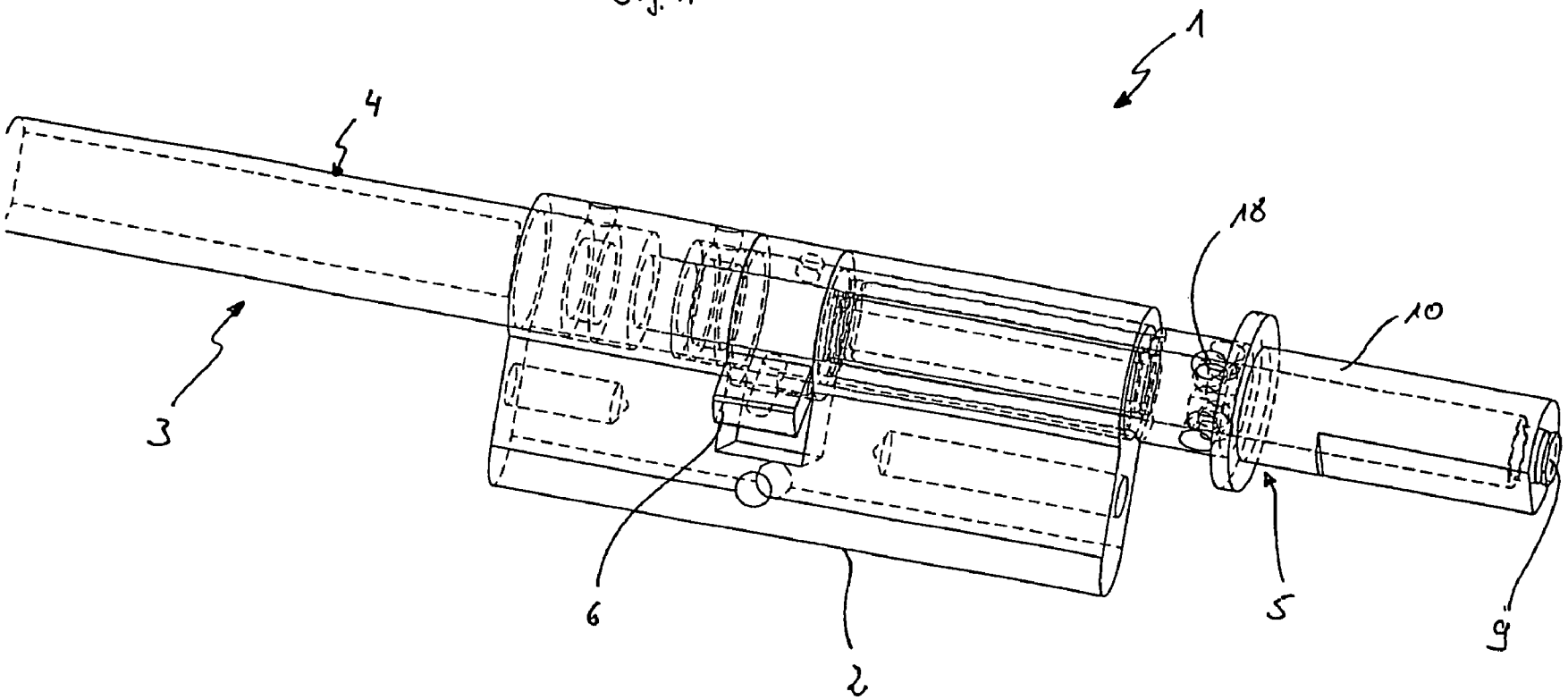

A lock as represented in the FIGS. 1 to 6 is formed as a mortise lock for installation in a door leaf and includes a locking cylinder 2 that is fixed in the door leaf which is not further shown. The locking cylinder 2 is penetrated by a shaft 3 that is formed of two sections 4 and 5.

Rotary knobs (not shown in FIG. 1) are fixed for rotation with the ends of these sections 4 and 5, by means of which rotary knobs a locking nose 6 of the cylinder 2 mounted on shaft 3 can be pivoted if necessary upon recognition of an authorisation code that unlocks the lock 1.

Figure 4:
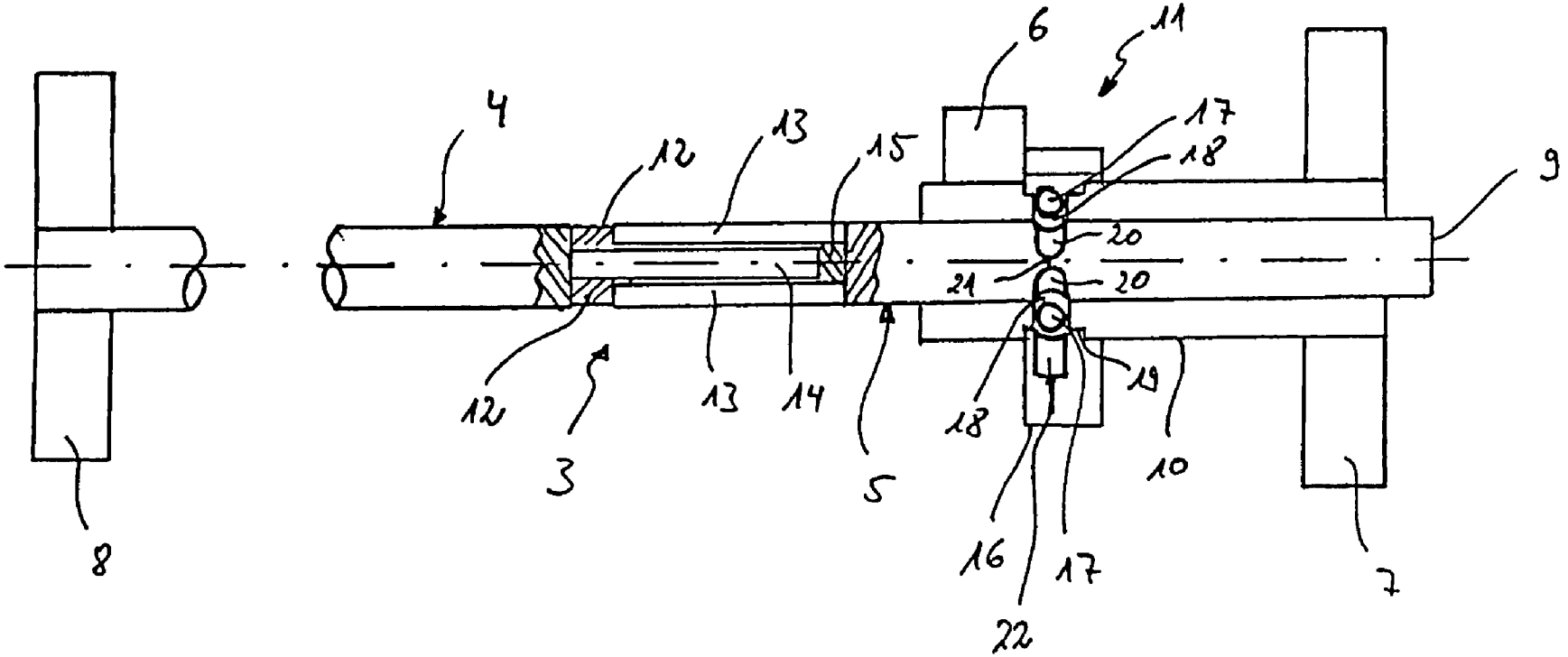
FIG. 4 a basic diagram of the shaft according to FIG. 2 in a side view.

The above-mentioned rotary knobs are shown in FIG. 4 and are designated by reference numbers 7 and 8. FIG. 4, to which reference is made in the following, also shows a basic diagram of the shaft 3.

The section 5 of shaft 3 is formed in two parts and includes two coaxially arranged parts 9 and 10, of which the first part 9 is coaxially arranged for rotation in the second part 10 of the first section 5 of shaft 3. The second part 10 of the first section 5 of shaft 3 is connected to the second section 4 of shaft 3 in a length-variable fashion.

Between the first part 9 and the second part 10 of the first section 5 of shaft 3 a coupling 11 still to be described in the following is provided, by means of which coupling the two parts 9 and 10 can be actively connected after recognition of an authorisation code.

The locking nose 6 of the locking cylinder 2 not shown in detail in FIG. 4 is fixed for rotation with the second part 10 of the first section of shaft 3. Consequently, the locking nose 6 can be pivoted both in the disengaged and engaged condition of the coupling 11, using the rotary knob 7 that is provided inside the room. The rotary knob 8 provided on the outside of the building can be actuated for pivoting the locking nose 6 only if an active connection exists between the first part 9 and the second part 10 of the first section 5 of shaft 3 which can be produced through the coupling 11. It can be seen that in the lock 1 according to the invention the structural components producing the active interconnection of the two parts 9 and 10 are arranged inside the room and are thus accessible from outside only under more difficult conditions.

The second section 4 of shaft 3 has on its end directed away from the rotary knob 8 two diametrically opposite, axially aligned cavities 12 which are engaged in a form-fit fashion by corresponding web-like projections 13 of the first part 9 of the first section 5 of shaft 3. In a similar manner the second section 4 also includes web-like projections 14 engaging in a form-fit fashion in correspondingly formed cavities 15 of the first part 9 of the first section 5 of shaft 3.

Owing to this construction it is possible to adjust the distance between the rotary knobs 7 and 8 corresponding to the material thickness of the door leaf (not further shown), this lock 1 allowing the insertion of merely a locking cylinder 2 of a particular length for door leafs of a different thickness. The coupling 11 is arranged in a housing 16 and consists of four rolling members 17 in the form of balls that are arranged in recesses 18 formed as radial bores in the second part 10 of the first section 5 of shaft 3. The recesses or receiving constructions 18 are arranged equally spaced over the periphery of the second part 10 of the first section 5 of shaft 3 within the region of a diameter reduction 19.

The first part 9 of the first section 5 of shaft 3 includes in the region of these recesses 18 cavities 20 that run about its surface area. Between the two cavities 20 webs 21 are formed which do, however, not protrude beyond the circumference of the first part 9 of the first section 5 of shaft 3.

Finally, the coupling 11 includes a sliding element 22 which is guided radially movable with respect to the shaft 3 and which can be pushed into the diameter reduction 19.

The diameter of the rolling members 17 formed as balls is larger than the depth of the recesses 18. In the disengaged state the sliding element 22 is pulled out of the diameter reduction 19 to such an extent that the first part 9 of the first section 5 of shaft 3 can freely rotate within the second part 10 of the first section 5 of shaft 3. Here, the rolling members 17 formed as balls are freely movable to such an extent that they evade radially within the recesses 18 when striking a web 21.

In this condition the rotary knob 8 can be rotated without the locking nose 6 being moved and because of that the lock 1 opened. If an authorisation code is input in the lock 1—this may be effected by means of a mechanical key, an electronic key or code numbers via a keyboard—the sliding element 22 will, upon recognition of the appropriate authorisation code, be pushed in a manner still to be described into the diameter reduction 19 to such an extent that the rolling members 17 lie in the cavities 20 and cannot be moved over and beyond the web 2, whereby the active connection between the second part 10 and the first part 9 of the first section 5 of shaft 3 is produced, so that the locking nose 6 is movable using the rotary knob 8.

Figure 5:
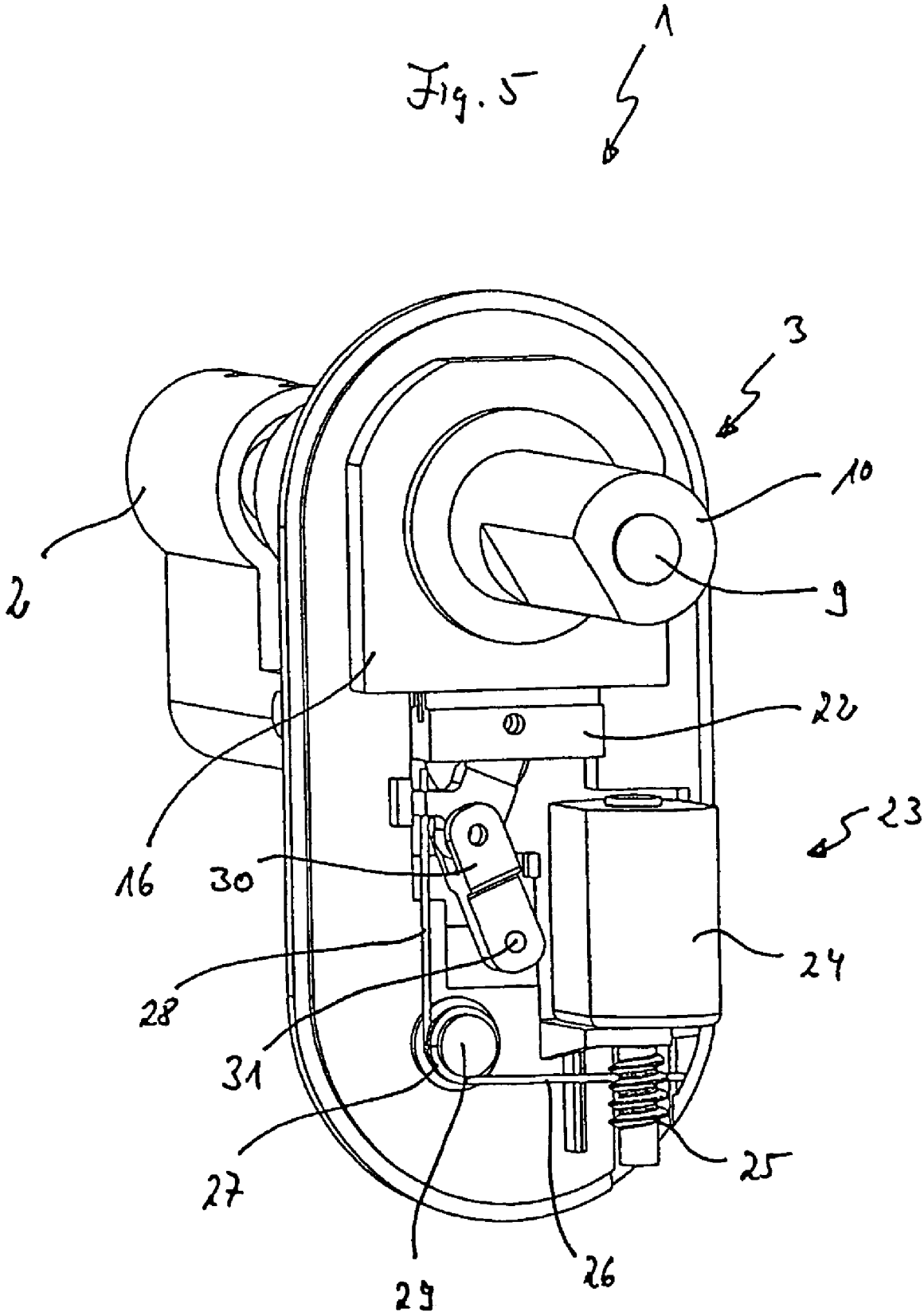
FIG. 5 a coupling of a lock according to FIG. 1 in a perspective side view.
Figure 6:
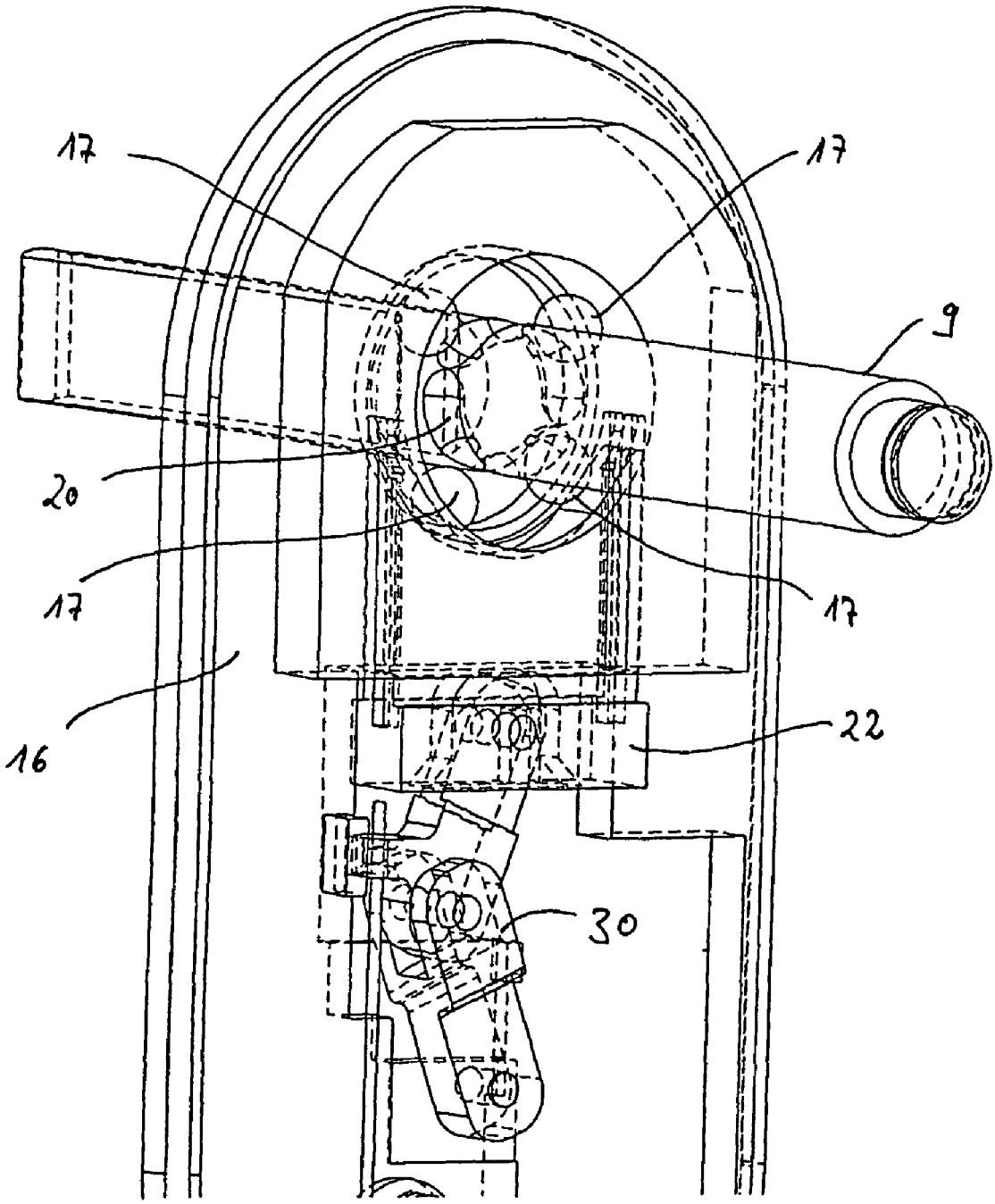
FIG. 6 the coupling according to FIG. 5 with the housing opened.

In FIG. 5 an embodiment of a driving unit 23 of the sliding element 22 is shown. The driving unit 23 consists of an electric motor 24 including a worm wheel 25 on its output shaft. In this worm wheel 25 an arm of a substantially L-shaped spring 27 is guided. The spring 27 has a second arm 28 and is supported on a cylindrically formed projection 29, with said arms 26, 28 extending from this projection 29.

The arm 28 is connected in a form-fit fashion to a knee lever 30 that can be pivoted about an axis 31 on one side and that is connected to the lower end of the sliding element 22 on the other side.

When the worm wheel 25 of the electric motor 24 is rotated, the arm 26 of the spring 27 in the initial position shown in FIG. 5 will move away from the electric motor 24, whereby the spring 27 is pivoted about the projection 29. Owing to this pivoting movement the arm 28 moves clockwise, transferring the knee lever 30 to an almost straight position, whereby the sliding element 22 is moved in the radial direction towards shaft 3 and moves a ball-shaped rolling member 17 into a cavity 20, in order to produce the active connection between the two parts 9 and 10 of the first section 5 of shaft 3.

Figure 2:
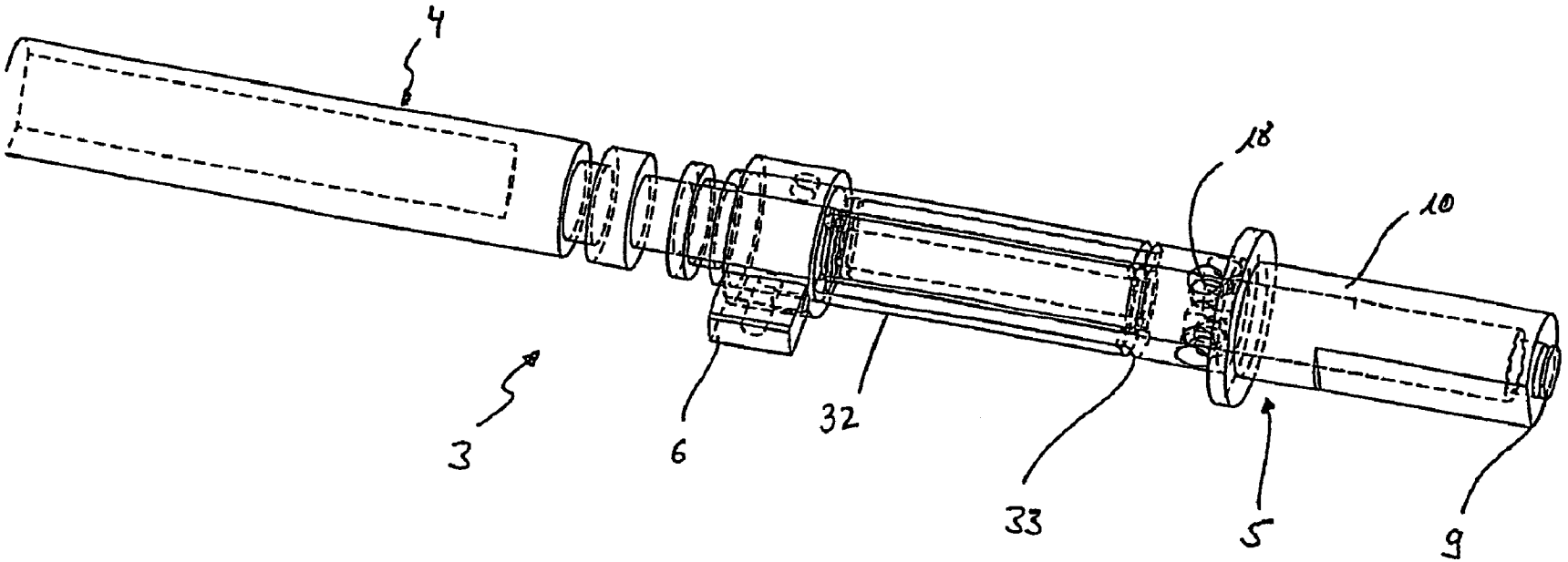
FIG. 2 the shaft according to FIG. 1 in a perspective side view.
Figure 3:
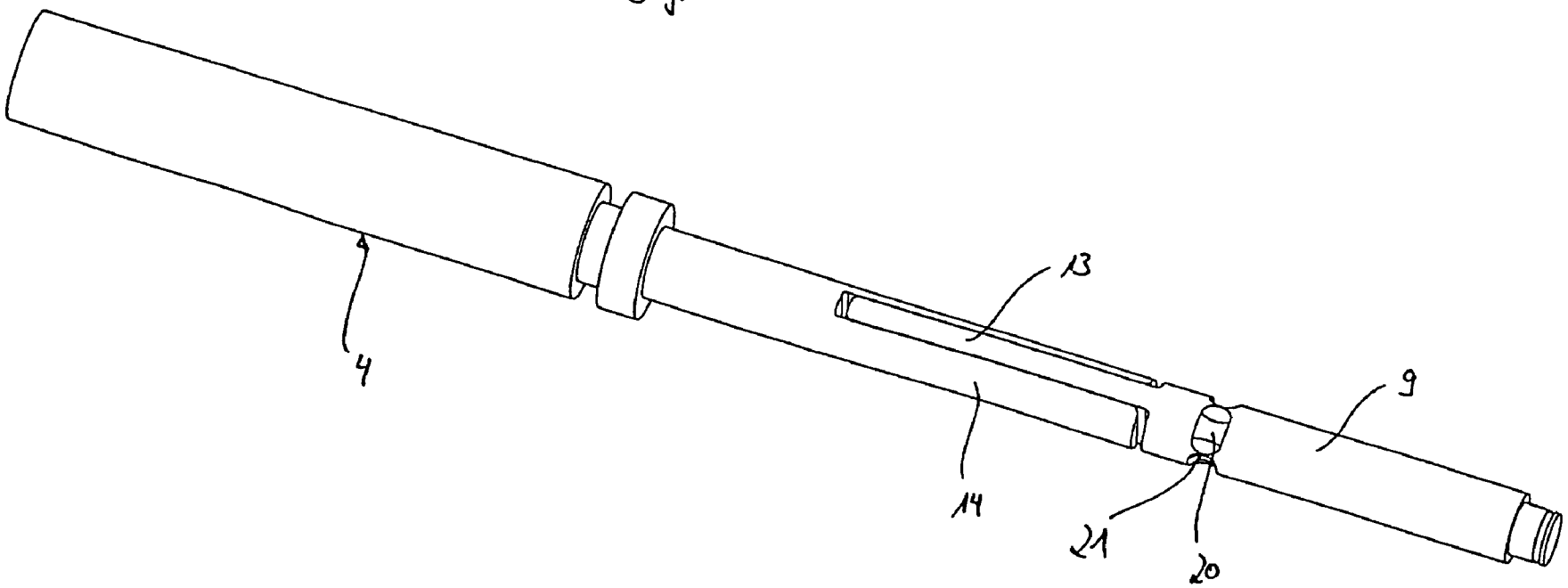
FIG. 3 a part of the shaft according to FIG. 2 in a perspective side view.

According to FIGS. 1 and 2 the second part 10 of the first section 5 of shaft 3 is also formed in two parts, the connection between the two elements 32, 33 that form the second part 10 of the first section 5 being formed analogously to the length-variable design of the connection between the first section 5 and the second section 4 of shaft 3. Accordingly, in this case, too corresponding projections and cavities are provided in the elements 32 and 33.

An embodiment of the lock 1 shown in the FIGS. 7 to 10 is also designed as a mortise lock for a door for installation in a door leaf. For components of this second embodiment which correspond to those of the first embodiment according to the FIGS. 1 to 6 the same reference numbers are used in the FIGS. 7 to 10.

The second embodiment of the lock 1 shown in the FIGS. 7 to 10 includes a locking cylinder 2 which is fixed in the door leaf not further shown. The locking cylinder 2 has a housing 34 in which a shaft 3 is supported for rotation, which shaft is formed of two sections 4 and 5. The section 5 of shaft 3 is formed in two parts and includes two coaxially arranged parts 9 and 10, of which the first part 9 is rotatably and coaxially arranged in the second part 10 of the first section 5 of shaft 3.

Between the first part 9 and the second part 10 of the first section 5 of the shaft 3 a coupling 11 is arranged which is still to be described in more detail in the following and through which the two parts 9 and 10 can be actively interconnected or disconnected after recognition of an authorisation code for opening and/or closing the lock 1.

The shaft 3 is supported in a bore 35 of the housing 34 and is sealed against the housing 34 in the region of the second part 10 of the first section 5, using O-rings 36. An additional O-ring 36 is provided between the first part 9 and the second part 10 of the first section 5 of shaft 3. The O-rings 36 are inserted in corresponding grooves 37 in the components.

The housing 34 further includes two threaded bores 38 into which screws for fixing rosettes (not further shown) can be screwed. The rosettes may also carry rotary knobs (not further shown), by means of which a locking nose 6 of the locking cylinder 2 fitted on the shaft 3 can be pivoted, if necessary, after recognition of an authorisation code unlocking the lock 1.

The locking nose 6 is formed as one piece with an annular body 39 that surrounds the second part 10 of the first section 5 of shaft 3 and is connected to this part in a manner fixed against rotation. To this end, the annular body 39 includes a bore 40 which is coaxially aligned with a bore in the shaft 3, namely the second part 10. In both bores 40 a pin 41 is inserted which connects the annular body 39 in a form-fit fashion to the second part 10. The pin 41 extends over the whole length of the bores 40 that extend up and into the locking nose 6.

In the region of the first part 9 of the second section 4 of shaft 3 the pin 41 penetrates through a continuous groove 42, without preventing the two parts 9 and 10 from a relative rotational movement when the coupling 11 is not engaged. However, the two parts 9 and 10 are interconnected in the axial direction of the shaft 3 by means of said groove 42 and said pin 41.

Figure 7:
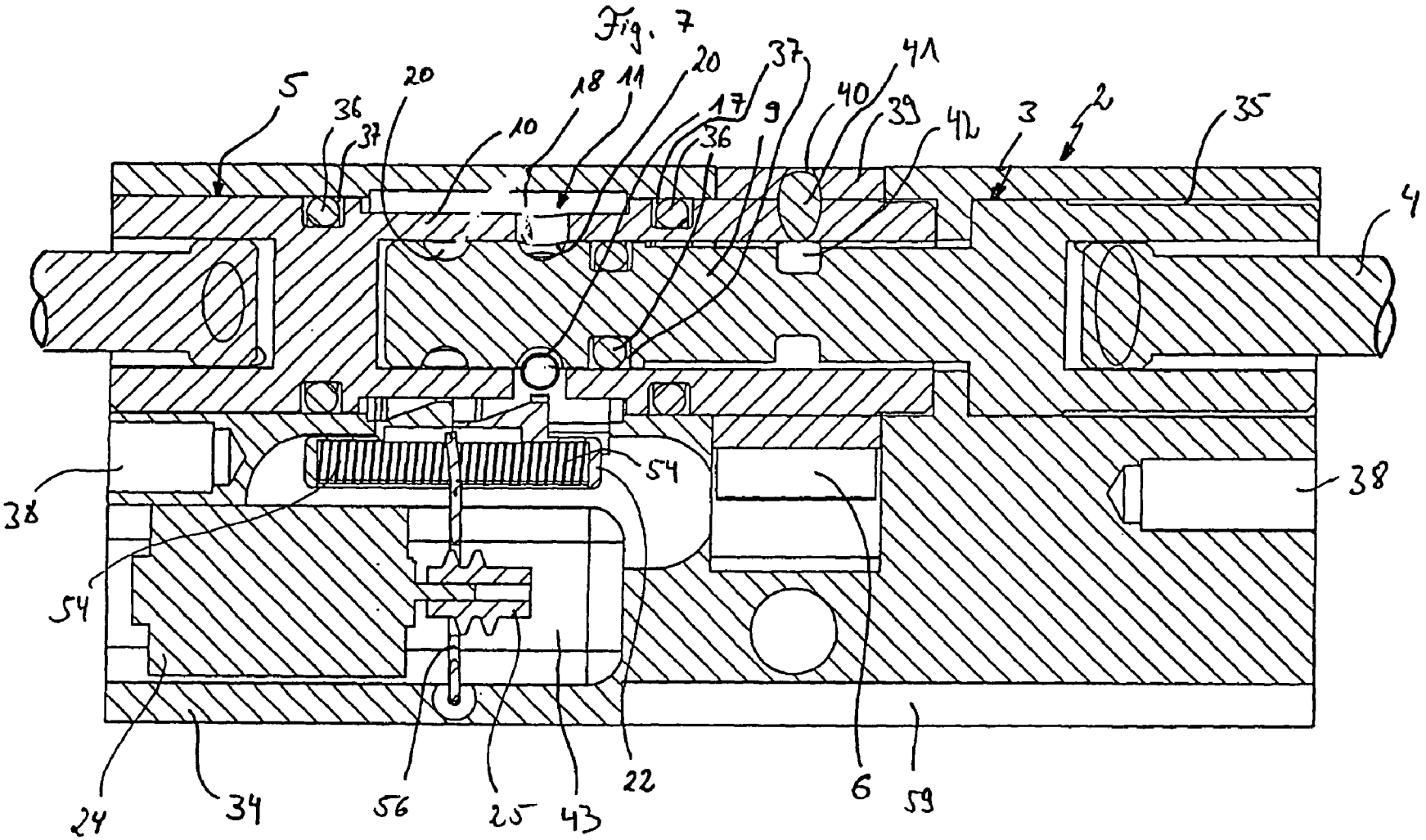
FIG. 7 a second embodiment of a lock in a sectional side view.
Figure 8:
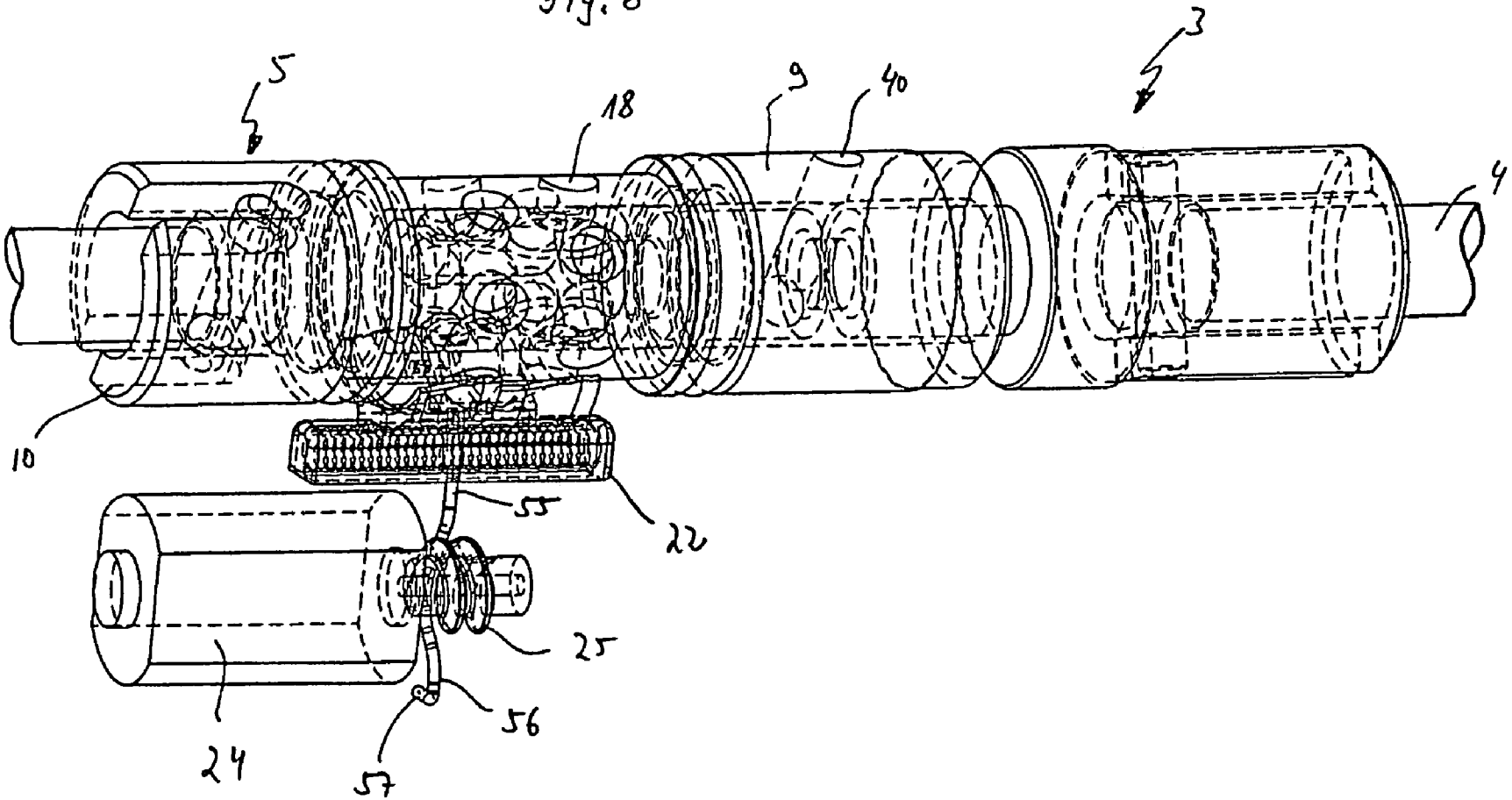
FIG. 8 the shaft and the driving unit of the second embodiment of the lock according to FIG. 7 in a perspective view.
Figure 9:
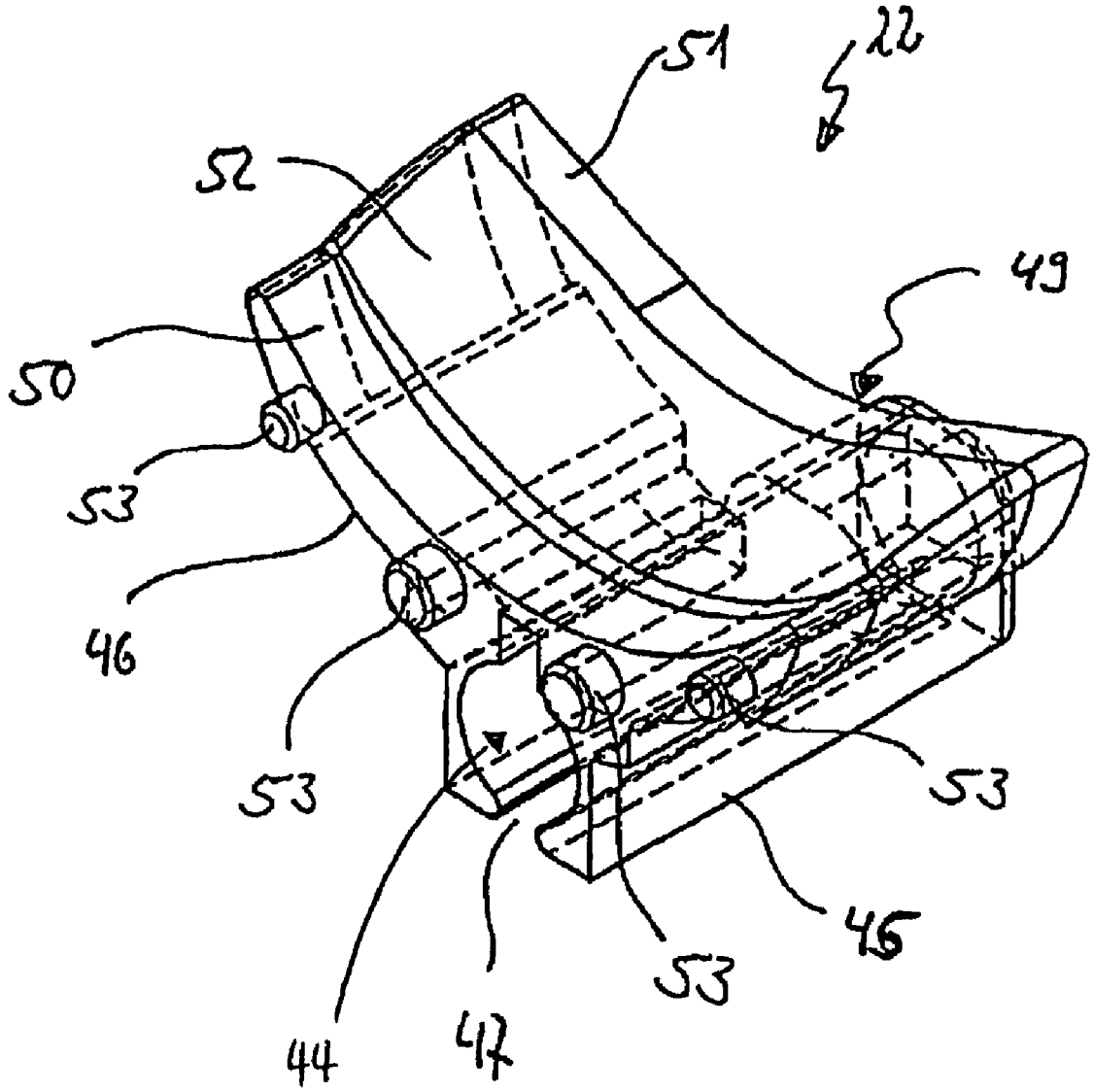
FIG. 9 a sliding element for the lock according to FIGS. 7 and 8 in a perspective view.

By the locking nose 6 being fixed for rotation with the second part 10 of the first section 5 of shaft 3 said locking nose 6 can be pivoted both in the disengaged and engaged state of the coupling 11, using the rotary knob arranged inside the room, i.e. on the left side in FIG. 7. But the rotary knob arranged on the outside of the building, i.e. on the right side in FIG. 7, can be actuated for pivoting the locking nose 6 only if an active interconnection exists between the first part 9 and the second part 10 of the first section 5 of shaft 3, which active interconnection can be produced through the coupling 11. It can be seen that in the lock 1 according to the invention the structural components that produce the active interconnection between the two parts 9 and 10 are arranged inside the room and for this reason are accessible from outside only under more difficult conditions.

The coupling 11 is arranged within the locking cylinder and consists of four ball-shaped rolling members 17 arranged in recesses or receiving constructions 18 formed as radial bores in the second part of the first section 5 of shaft 3. The recesses 18 are arranged equally spaced about the periphery of the second part 10 of the first section 5 of shaft 3.

In the region of these recesses 18 the first part 9 of the first section 5 of shaft 3 has cavities 20 running about its surface area. Between the two cavities 20 webs are formed which do, however, not protrude beyond the circumference of the first part 9 of the first section 5 of shaft 3.

Finally, the coupling 11 includes a sliding element 22 which is guided in such a manner that it is axially movable with respect to the shaft 3. The sliding element 22 is arranged in a hollow space 43 within the housing 34 and consists, according to FIG. 9, of a base body 45 including bores 44 extending in the longitudinal direction and having arranged thereon a guide body 46.

Figure 10:
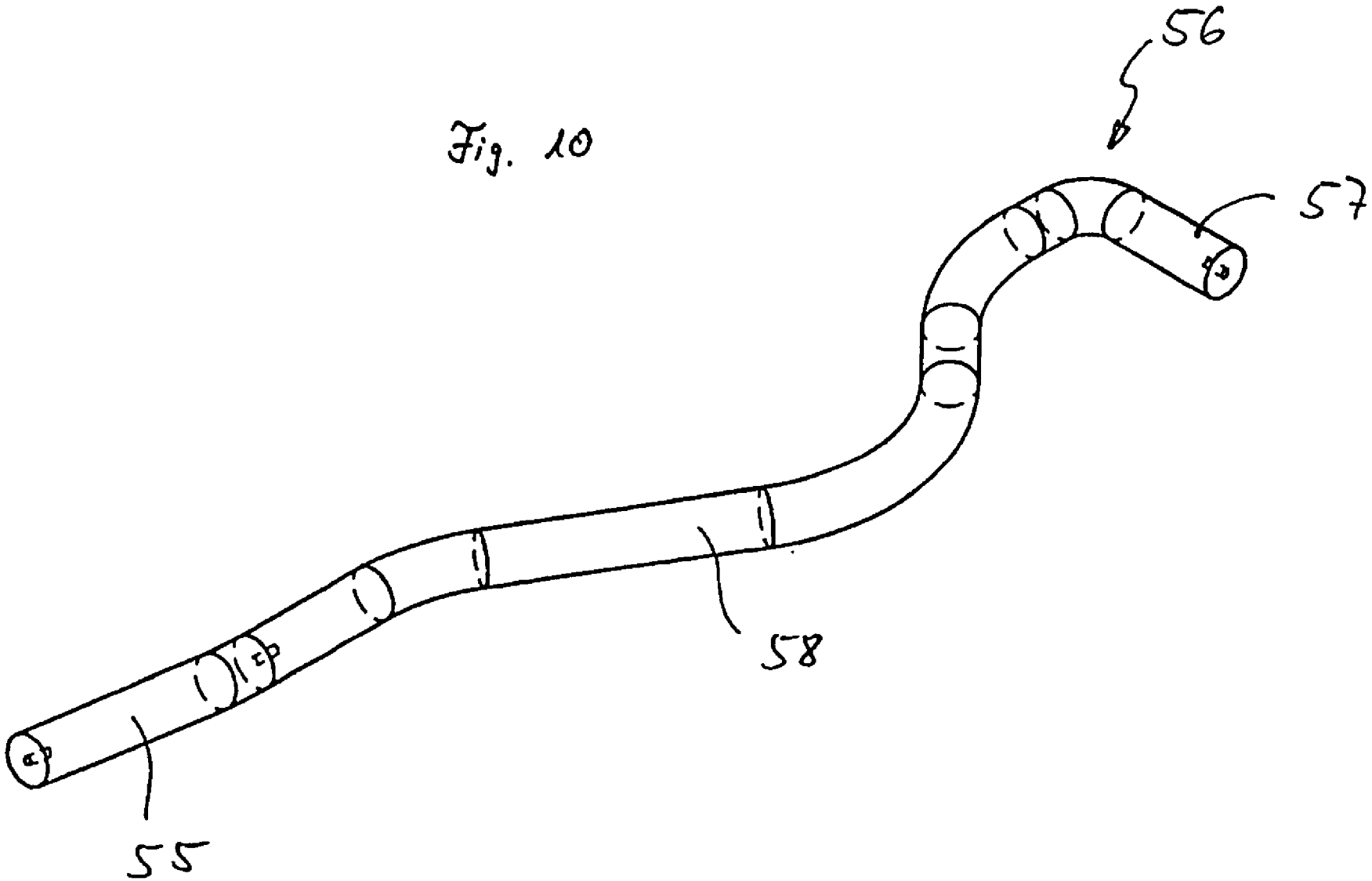
FIG. 10 a lever for the actuation of the sliding element in a perspective view.

On one side of the base body 45 said bore 44 is provided with a slot 47 in which a lever 56 is guided which is still to be described in the following and which is shown in FIG. 10. In the region of its surface 49 facing the shaft 3 the guide body 46 is formed so that it approximately corresponds to a part of the outer surface area of the shaft 3 and includes a first surface section 50, a second surface section 51 and an inclined surface 52 interconnecting said two surface sections 50 and 51. The first surface section 50 is arranged at a distance to the outer surface area of the first part 9 of the first section 5 of shaft 3 which at least corresponds to the diameter of the rolling member 17. The diameter of the ball-shaped rolling members 17 is larger than the depth of the recesses 18. The second surface section 51 is arranged at a distance to the outer surface area of the first part 9 of the first section 5 of shaft 3 which is substantially smaller than the diameter of the rolling members 17. On its front side the sliding element 22 which is formed in two parts includes cams 53 in the region of a first half shown in FIG. 9, which cams can be inserted for frictional engagement in corresponding bores in a second half (not further shown) of the sliding element 22.

When the sliding element 22 is in a position in which the first surface section 50 is arranged under the rolling member 17, the coupling 11 is disengaged and the two parts 9 and 10 of the first section 5 of shaft 3 are twistable relative to each other. When the sliding element 22 is now displaced in such a manner that the second surface section 51 comes in the region under the rolling members 17, said rolling members 17 are pushed into the cavities 20 via the inclined surface 52, so that a form-fit connection between the two parts 9 and 10 of the first section 5 of shaft 3 is produced. In this state the coupling 11 is engaged.

In the bore 44 of the base body 45 two springs 54 are inserted which take support on the front side of the bore 44. Between the springs 54 a first end 55 of the lever 56 is arranged, which lever is rotatably supported in the housing 34 of the locking cylinder 2 by the second end 57 thereof. The lever 56 is movable along the slot 47 of the base body, with the moving distance being limited by the springs 54. By its central part 58 the lever 56 engages a worm wheel 25 which is fixed against rotation on the driving shaft of an electric motor 24.

The electric motor 24 is arranged under the sliding element 22 in the hollow space 43. The lever 56 which is formed with a round cross-section is shown in detail in FIG. 10 and is movable via the worm wheel 25 in the direction opposite to the displacement of the sliding element 22. The second end 57 of the lever 56 is bent at right angles.

The movement of the sliding element 22 is damped by the springs 54, so that a jerky engagement of the coupling 11 is prevented. The springs 54 further assist the movement of the sliding element 22 from the disengaged to the engaged position of the coupling 11 and vice versa. All in all, a smooth sliding movement of the sliding element 22 can thus be attained. The springs 54 also serve as energy storage means for the event that the movement of the sliding element 22 is obstructed.

The electric motor 24 is connected to a control electronic (not further shown), using cables and particularly stranded conductors (not further shown). The cables are passed through a cable duct 59 that is arranged in the lower part of the housing 34 in the longitudinal direction of the locking cylinder 2. The cable duct 59 has an inside width of 1 mm and is sealed against the hollow space 43 for example by a rubber gasket, in order to prevent moisture and/or dirt from penetrating into the hollow space 43. The O-rings 36 are arranged for the same purpose.

The control electronic serves for the verification of an authorisation code. If the control electronic recognizes an authorisation code that permits actuation of the lock 1, the electric motor 24 is driven for a predetermined period of time and the worm wheel 25 is rotated. The sliding element 22 is moved through the lever 56 until the coupling 11 is engaged. This, however, does not require the time of driving the electric motor 24 to correspond to the movement of the sliding element 22. In the engaged state of the coupling the locking nose 6 can be actuated from both sections 4, 5 of the shaft 3, so that the lock 1 can be opened both from outside and inside. The control electronic can be arranged for example in the above-mentioned rosettes and/or the rotary knobs.

In the closed, i.e. locked state the outside rotary knob (not further shown) can be turned, without the locking nose 6 being moved and because of this the lock 1 opened. If an authorisation code is input now in the lock 1—this can be done by means of a mechanical key, an electronic key, a biometric sensor, a transponder, radio transmission or code numbers via a keyboard—the sliding element 22 is displaced in the axial direction of the locking cylinder 2 after the correct authorisation code has been recognized, so that the rolling members 17 lie in the cavities 20 and cannot be moved over and beyond the web between adjacent cavities, whereby the active connection between the second part 10 and the first part 9 of the first section 5 of the shaft 3 is produced, so that the locking nose 6 can be moved, using the rotary knob 8.

Figure 11:
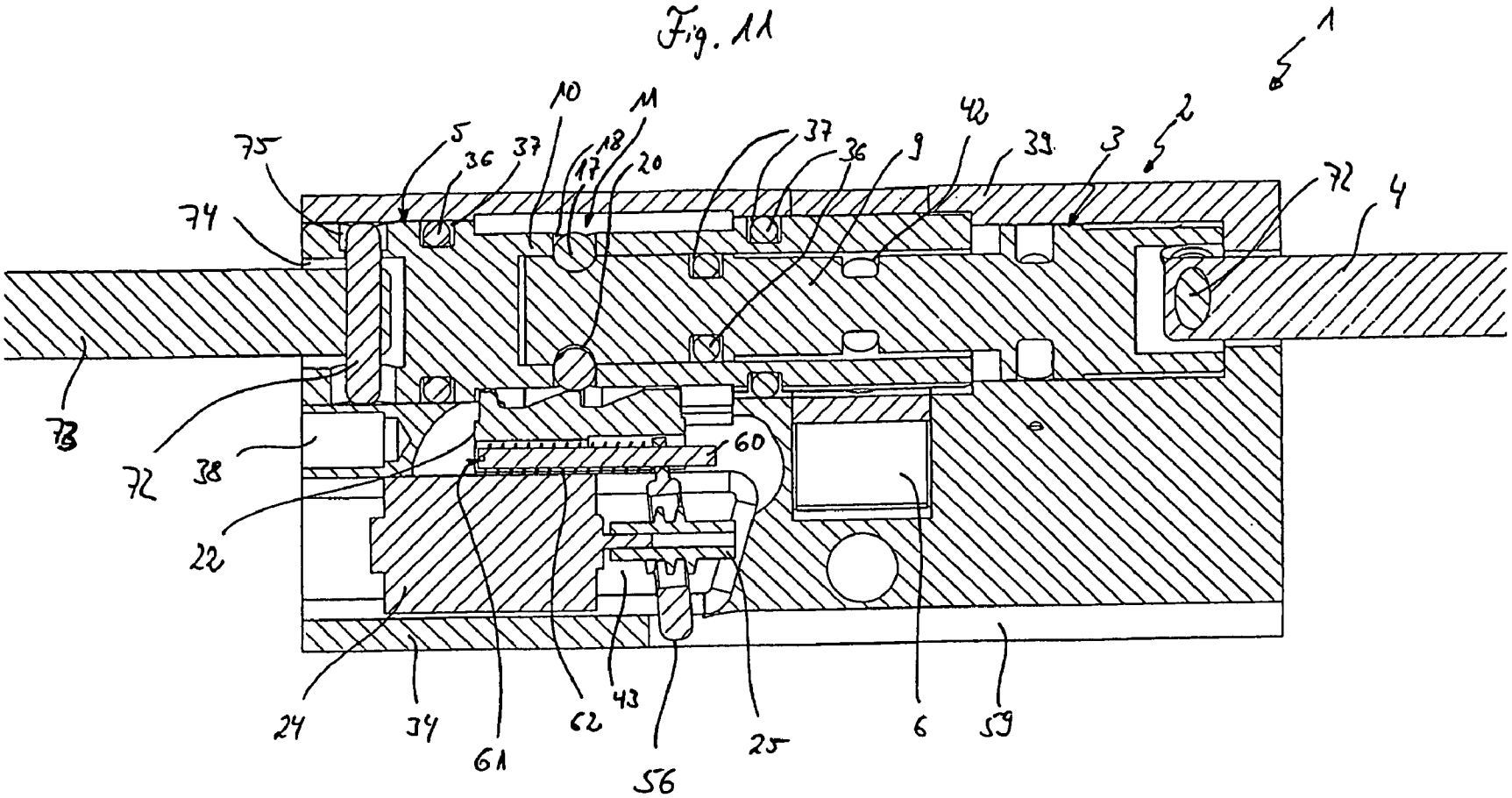
FIG. 11 a third embodiment of a lock in a sectional side view.

FIG. 11 shows a further embodiment of a lock, wherein components in FIG. 11 that correspond to those of the embodiment shown in FIG. 7 carry the same reference numbers. The essential differences between the two embodiments will be described in detail in the following.

In the embodiment according to FIG. 11 the sliding element 22, of which the surface facing the shaft 3 is formed corresponding to the surface of the sliding element 22 according to FIG. 7, has on the opposite surface thereof a cylindrically formed gudgeon 60 which is supported by its one end 61 for pivoting on the sliding element 22. The gudgeon 60 is surrounded by a tension-compression spring 62 and penetrates by its free end opposite the end 61 through a bore 63 in a projection 64 of the lever 56. The diameter of the bore 63 is slightly larger than the diameter of the gudgeon 60, so that the gudgeon 60 is guided with a small tolerance within the bore 63 of the projection 64.

Figure 12:
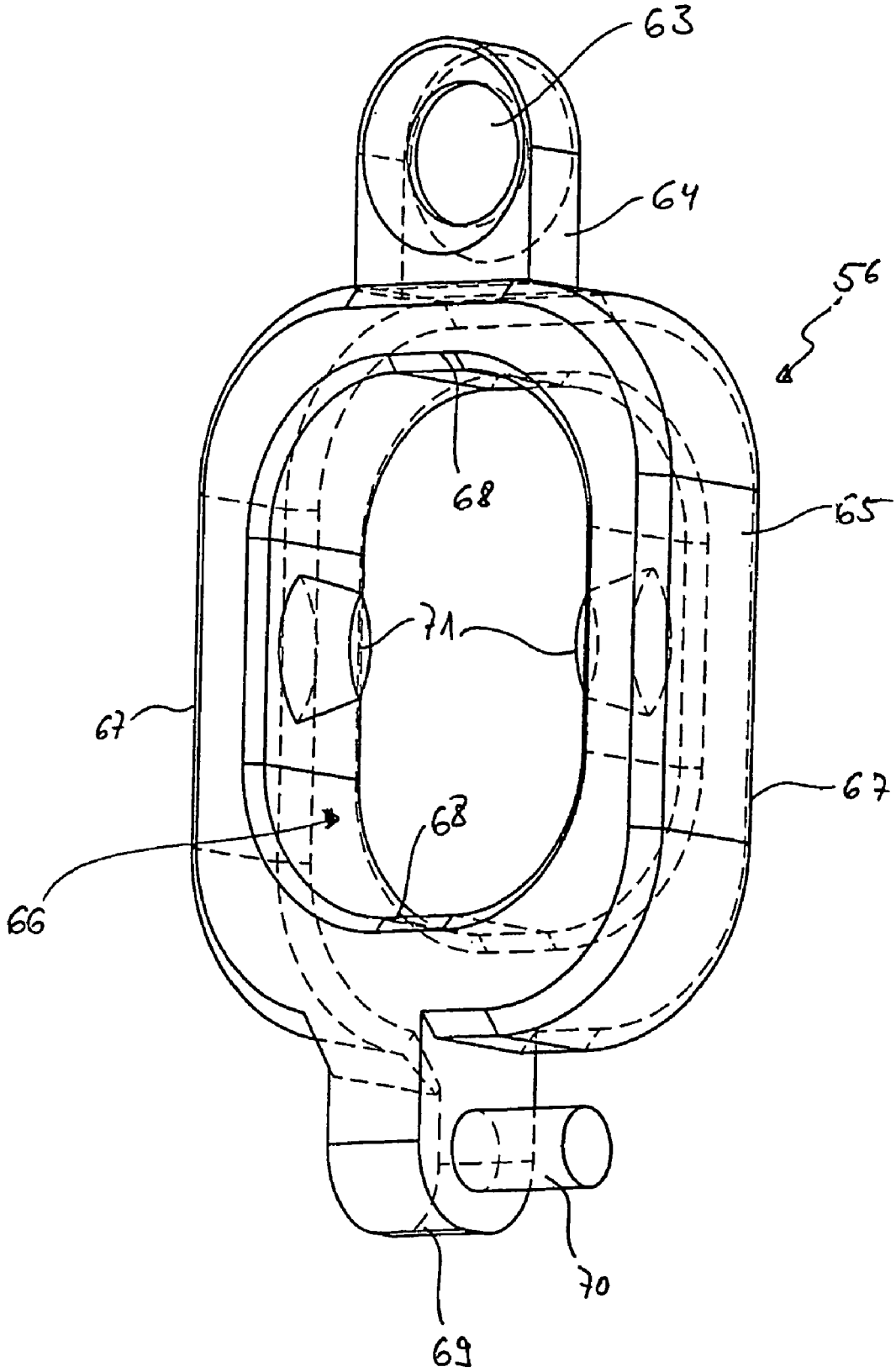
FIG. 12 a lever for the actuation of the sliding element in the lock according to FIG. 11 in a perspective view and FIG. 13 a fourth embodiment of a lock in a sectional side view.

According to FIG. 12, the lever 56 is frame-shaped and has a substantially rectangular base body 65 that delimits an opening 66. Accordingly, the base body 65 respectively consists of two mutually parallel aligned long legs 67 and two short legs 68 that are also aligned parallel to each other and interconnect the two long legs 67. The legs 67, 68 merge into each other in the form of a section of a circle of an arc.

In the region of the outer surface of the upper short leg 68 the first projection 64 having the bore 63 is arranged.

On the opposite side on the outer surface of the second short leg 68 a second projection 69 is provided having fixed to it a pin 70 that extends parallel to the longitudinal extension of the short leg 68 and can be inserted in a corresponding bore in the lock 1 within the region of the cable duct 59, so that the lever 56 is supported for pivoting about the pin 70 within the hollow space 43.

On their inner surfaces the long legs 67 have two mutually opposite pins 71 directed towards each other which are formed as truncated cones and which engage the worm thread of the worm wheel 25. Accordingly, by rotation of the worm wheel 25 the lever 56 is pivoted about the pin 70, so that the lever due to the fact that it is coupled to the gudgeon 60 and assisted by the tension-compression spring 62 displaces the sliding element 22 in the longitudinal direction of lock 1, thus opening or closing the coupling 11.

The second section 4 is connected to the first part 9 through a driving pin 72 in such a manner that tensile and pressure forces are transmissible even at a non-coaxial alignment of the second section 4 with the first part 9 and hence at a deviation of axes of these two components, without this causing any damage to the second section 4 or the first part 9.

The same is true for the second part 10 and a driving shaft 73 connected to it. To this end, the second part 10 according to FIG. 11 includes a location opening 74 in the longitudinal direction of the lock 1. In this location opening 74 the driving shaft 73 is inserted, which driving shaft has on the end thereof which is located in the location opening 74 a radially extending bore that is penetrated by a driving pin 72.

The second part 10 of the shaft 3 includes on its end having the location opening a radial bore 75 that is also penetrated by the driving pin 72, the diameter of the radial bore 75 being slightly larger than the diameter of the driving pin 72. The diameter on both radial ends can be differently dimensioned.

Figure 13:
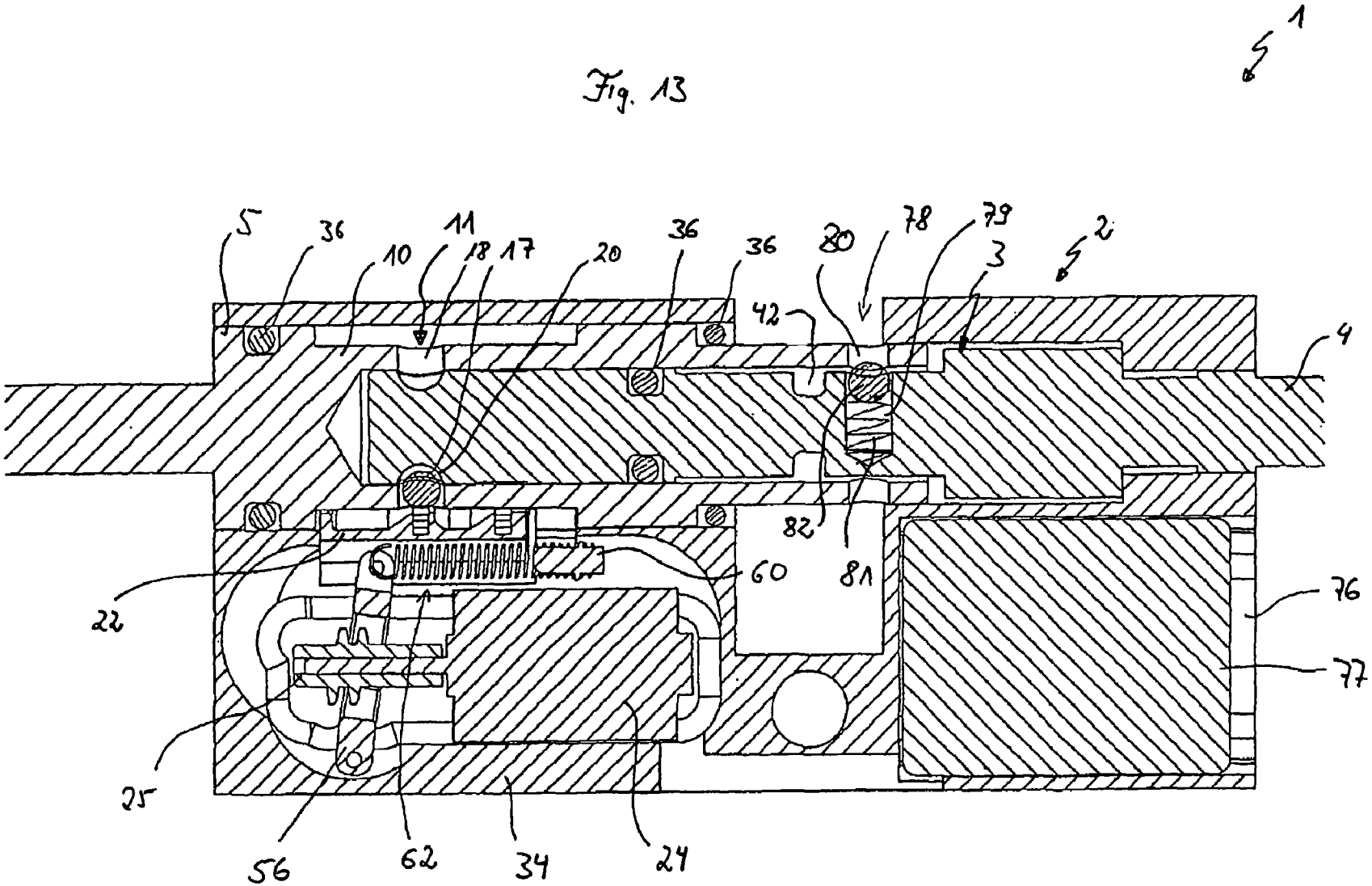

A further embodiment of a lock 1 is shown in FIG. 13. This embodiment of the lock substantially corresponds to the embodiment of the lock 1 according to FIG. 11, so that corresponding components are designated by corresponding reference numbers.

Differently from the embodiment according to FIG. 11 the tension-compression spring 62 is not fixed to a gudgeon extending over the entire length of the tension-compression spring 62. Rather it is said tension-compression spring 62 that is fixed to a gudgeon 60, which forms part of the sliding element 22, only by a partial portion of one end. By its second end the tension-compression spring 62 is fixed to the lever 56. The lever 56 is pivoted through the worm wheel 25 of the driving motor 24, so that the tension-compression spring 62 is bent or released. For the engagement of the sliding element 22 with the worm wheel 25 two projections (not further shown in FIG. 13) are provided on the sliding element 22. The displacement of the sliding element 22 is then effected through the tension-compression spring 62.

In the embodiment shown the sliding element 22 is formed of a plastic material and substantially corresponds to the sliding element 22 shown in FIG. 12.

The lock 1 according to FIG. 13 further includes a recess or receiving construction 76 in which a plate bar 77 can be inserted which for example includes an integrated circuit for controlling the motor 24 and, if necessary, data in the form of a locking secret. The plate bar 77 can be accordingly designed as an evaluation plate bar.

In addition, the lock 1 includes a catch 78 between the two sections 4 and 5 of the shaft 3. This catch 78 makes sure that when the sliding element 22 is actuated, in particular when it is moved from the engaged to the disengaged state, the two sections 4 and 5 of the shaft 3 are arranged in a defined position in which the recesses 18 are arranged centrical over the cavities 20, in order to avoid that the rolling members 17 and the sliding element 22 are clamped.

The catch 78 consists of a radial bore 79 formed as blind hole in the second section 4 and a radial bore 80 in the first section 5 of the shaft 3. In the radial bore 79 a spring 81 and a ball 82 are supported, which ball is pushed at the defined position into the bore 80 of the first section 5. The diameter of the ball 82 is slightly larger than the diameter of the radial bore 80, in order to avoid that the ball 82 is pushed out.

The invention claimed is:

1. A lock comprising:

a locking cylinder (2) having a housing (34); and a shaft (3);

said shaft (3) is rotatably supported in said housing (34);

said shaft (3) has a first section (5) and a second section (4), the first section (5) and the second section (4) being connectable with each other;

said first section (5) comprises a first and a second part (9, 10) being rotatable against each other, wherein the second part (10) is rotationally affixed to said first section (5);

said first section (5) has a handle (7) at one of it ends, the handle (7) being rotationally affixed to said first section (5);

said second section (4) is connected with said first part (9) and has a handle (8) at one of it ends, the handle (8) being rotationally affixed to said second section (4);

a coupling means (11) for providing a coupling effect between said first and said second part (9, 10) of said first section (5) of said shaft (3) upon identification of an authorization code, the coupling means (11) comprising:

at least two rolling members (17);

first recesses (18) arranged at said second part (10) of said first section (5) for guiding said rolling members (17);

second recesses (20) arranged at said first part (9) of said first section (5) of said shaft (3), said recesses (20) being orientated in peripheral direction of said first part (9), and said recesses (20) being axially arranged corresponding to said first recesses (18) so that said first and said second recesses (18, 20) are opposed to each other;

a sliding element (22) being radially or axially movable in relation to said shaft (3) in order to displace said rolling members (17) into said second recesses (20) for establishing said coupling effect; and a driving unit (23) for actuating said sliding element (22).

2. Lock according to claim 1, characterized in that the at least two rolling members (17) are formed as balls or rolls.

3. Lock according to claim 1, characterized in that the sliding element (22) is displaceable in the radial direction of the shaft (3) through a knee lever (30).

4. Lock according to claim 1, characterized in that the sliding element (22) is driven by means of an electric motor (24) which includes on the output side thereof a worm wheel (25) with a spring (27) having two arms (26, 28) guided therein, said spring (27) being articulated by one arm (26) in the worm wheel (25) and by the second arm (28) to the sliding element (22).

5. Lock according to claim 1, characterized in that the at least two rolling members (17) are juxtaposed in plural and at least in two rows.

6. Lock according to claim 1, characterized in that the driving unit (23) of the sliding element (22) is formed as a lifting magnet.

7. Lock according to claim 1, characterized in that the sliding element (22) is arranged in a housing (16) that covers the first recesses (18) and the rolling members (17).

8. Lock according to claim 1, characterized in that the second part (10) of the first section (5) of the shaft (3) includes in the region of the first recesses (18) having the rolling members (17) a diameter reduction (19) of a width which substantially corresponds to the width of the sliding element (22).

9. Lock according to claim 1, characterized in that the sliding element (22) is displaceable in the axial direction of the shaft (3) through a lever (56).

10. Lock according to claim 9, characterized in that the lever (56) is supported by one end (57) for rotation in the locking cylinder (2).

11. Lock according to claim 9, characterized in that the lever (56) engages by its first end (55) in an opening of the sliding element (22), which is opening is formed as a slot (47).

12. Lock according to claim 9, characterized in that the lever (56) is guided by its central portion (58) in a worm wheel (25) that is arranged on a driving shaft of a driving motor (24).

13. Lock according to claim 9, characterized in that the lever (56) is formed as a frame and includes two projections (64, 69) serving to connect the lever (56) to the sliding element (22) on one side and to the locking cylinder (2) on the other side.

14. Lock according to claim 13, characterized in that the lever (56) includes two pins (71) directed one towards the other and engaging a worm thread of a worm wheel (25).

15. Lock according to claim 9, characterized in that in the sliding element (22) at least one spring (54) is arranged on each of the two sides of a first end (55) of the lever (56), which springs are bent or released when the lever (56) is moved.

16. Lock according to claim 1, characterized in that a driving motor (24) is arranged in the locking cylinder (2).

17. Lock according to claim 1, characterized in that a locking nose (6) is rotationally affixed with the shaft (3), with the second part (10) of the first section (5) of the shaft (3).

18. Lock according to claim 17, characterized in that the locking nose (6) is arranged on an annular body (39) surrounding the shaft (3), which annular body includes a pin (41) receiving bore (40) that is coaxially aligned with a bore in the shaft (3).

19. Lock according to claim 18, characterized in that the bore (40) extends into the locking nose (6).

20. Lock according to claim 1, characterized in that a pin (41) tangentially extends through a groove (42) aligned in the first part (9) of the shaft (3).

21. Lock according to claim 1, characterized in that the first section (5) of the shaft (3) is formed in two parts, the first part (9) of the first section (5) of the shaft (3) being connected in a length-variable fashion to the second section (4) of the shaft (3), and the second part (10) of the first section (5) of the shaft (3) being fixed for rotation with the handle (7) and being connectible to the first part (9) of the first section (5) of the shaft (3) through the coupling (11).

22. Lock according to claim 21, characterized in that the first and second parts (9, 10) of the first section (5) of the shaft (3) are arranged coaxially to each other.

23. Lock according to claim 22, characterized in that the second section (4) of the shaft (3) includes at least two diametrically opposite, axially aligned cavities (12) which are engaged in a form-fit fashion by corresponding projections (13) of the first part (9) of the first section (5) of the shaft (3).

24. Lock according to claim 23, characterized in that the second part (10) of the first section (5) of the shaft (3) is connected to a locking nose (6) of the locking cylinder (2).

25. Lock according to claim 24, characterized in that the locking nose (6) is fixed against rotation on the first or second section (5, 4) of the shaft (3) which extends coaxially with the first part (9) of the first section (5) of the shaft (3) and is connected in a form-fit fashion to the second part (10) of the first section (5) of the shaft (3).

26. Lock according to claim 25, characterized in that the first or second section (5, 4) of the shaft (3) is adjustable in a length-variable fashion with respect to the second part (10) of the first section (5) of the shaft (3).

27. Lock according to claim 26, characterized in that the shaft includes at least two diametrically opposite, axially aligned cavities (12) which are engaged in a form-fit fashion by corresponding projections of the first part (9) of the first section (5) of the shaft (3).

* * * * *